US005304015A

United States Patent [19]

Sonomura

[11] Patent Number: 5,304,015

[45] Date of Patent: Apr. 19, 1994

[54] PILE GRABBER APPARATUS

[76] Inventor: Roy N. Sonomura, 35 Terrace Cir., Hilo, Hi. 96720

[21] Appl. No.: 18,518

[22] Filed: Feb. 17, 1993

[51] Int. Cl.[5] ..... E02D 7/06

[52] U.S. Cl. ..... 405/232; 405/256; 414/745.2

[58] Field of Search ..... 405/228, 232, 233, 154, 405/303, 256; 414/745.1, 745.2, 745.5, 745.8

[56] References Cited

U.S. PATENT DOCUMENTS 2,880,031 3/1959 Dark ..... 294/87
3,019,608 2/1962 Marmion ..... 405/232
3,207,326 9/1965 Enix .
3,529,731 9/1970 Penny .
3,561,615 2/1971 Forsberg et al. .
3,860,122 1/1975 Cernosek .
4,697,959 10/1987 Kinnan ..... 405/232
4,709,764 12/1987 Gibbons ..... 405/232 X
4,755,080 7/1988 Cortlever et al. ..... 405/232 X

*Primary Examiner*—David H. Corbin
*Attorney, Agent, or Firm*—Jacobson, Price, Holman & Stern

[57] ABSTRACT

A pile grabbing apparatus comprising a steel I-beam of appropriate length supporting two claw assemblies. The claw assemblies are each driven by two hydraulic cylinders to grab and hold a concrete pile. A pair of steel support plates are welded onto the I-beam and with a "quick coupler", the I-beam is attached to the arm of a mobile excavating apparatus, such as a dirt excavator. The hydraulic cylinders are connected to hydraulic hoses and controlled by a control module. The operator at the control module may manipulate the claw assemblies to open and close.

14 Claims, 5 Drawing Sheets

PILE GRABBER APPARATUS

BACKGROUND OF THE INVENTION

The present invention relates to a method and apparatus for facilitating installation of a pile into the ground.

In many construction projects, such as bridges, it is necessary to drive structures known as "piles" into the ground. Traditionally, what is known as a fixed lead apparatus is used to align and drive the pile into the ground. Briefly, a fixed lead apparatus consists of a fixed lead mounted to a crane. A hammer is attached to or is part of the fixed lead. The crane is moved to position the fixed lead in the area where the pile is to be driven. If the piles are to be driven through water, usually a template with pockets is welded to a cofferdam and the fixed lead is positioned over the template.

A second crane pulls or lifts a pile to the crane with the fixed lead. The crane with the fixed lead lifts or aligns the pile into position. The pile driver then commences to pound the pile into the ground. Once the pile is driven sufficiently into the ground, the fixed lead is moved to the next pocket in the template where the next pile is to be driven. Eventually, after a complete series of piles is driven, the template must be removed and a new template installed.

This fixed lead process is a time consuming process, with or without templates. In addition, two cranes are needed for this process and it is cumbersome to correct alignment should a pile go out of plumb while being driven.

No device in a single apparatus is heretofore known which is capable of picking up horizontally disposed piles and positioning them vertically for association with a pile driver.

SUMMARY OF THE INVENTION

It is a primary object of the present invention to provide an apparatus in which only one crane and one excavator is needed to drive a pile.

It is a further object of the present invention to eliminate the need for templates in a pile driving process.

It is still a further object of the present invention to provide an apparatus which allows for easy correction of alignment should a pile go out of plumb while being driven.

Still another object of the present invention is to speed up the time needed to collect, position and drive a pile.

Briefly, the present invention is a pile grabbing apparatus comprising a steel I-beam of appropriate length supporting two pairs of claw assemblies. The claw assemblies are each driven by two hydraulic cylinders to grab and hold a concrete pile. A pair of steel support plates are welded onto the I-beam and attached using a "quick coupler" assembly onto a mobile excavating apparatus, such as a dirt excavator.

There are a drive module and a control module. The drive module includes hydraulic cylinders and supply/-return hydraulic hoses. The control module is mounted on the I-beam and includes operating levers. The hydraulic pressure is supplied by the host excavator. The operator of the control module controls the movement of the claws.

The above and other objects and advantages of the present invention will become more readily apparent when reference is made to the following description taken in conjunction with the accompanying drawings.

DETAILED DESCRIPTION OF THE DRAWINGS

Figure 1:
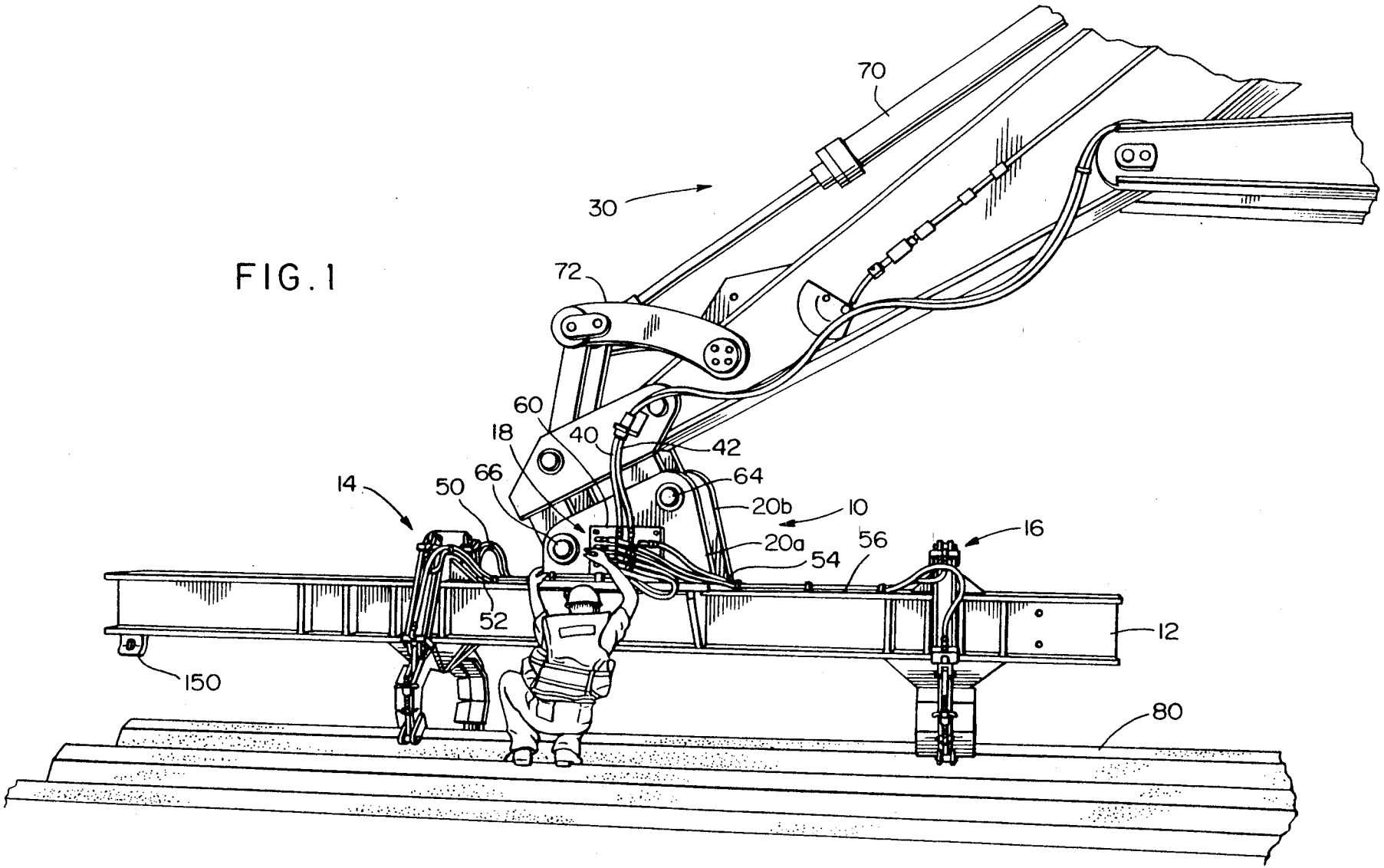
FIG. 1 is a perspective view of the pile grabber illustrating an operator positioning the apparatus to pick up a horizontally disposed pile.

Referring first to FIGS. 1–4, the pile grabber according to the present invention is generally shown at 10. The pile grabber 10 comprises a steel I-beam support member 12 having two pairs of claw or clamping assemblies 14 and 16. The I-beam 12 includes two steel link support plates 20*a* and 20*b* which are welded onto the I-beam and drilled with holes to bolt the pile grabber to the arm of a mobile excavating apparatus or other similar piece of equipment. The term "mobile excavating apparatus" may include other equipment that have a movable arm. The arm is shown at reference numeral 30. A Caterpillar 245 dirt excavator is an example of the type of equipment to which the pile grabber 10 may attach. The claw assemblies 14 and 16 attach to the I-beam at claw support plates 32 and 34, respectively. The link support plates 20*a* and 20*b* are attached at a distance set off from the claw assembly 14 approximately equal to one-quarter (¼) of the total distance between the claw assembly 14 and the claw assembly 16. Operator support steps 24 and 26 are provided on the I-beam 12 proximate the claw assembly support plates 32 and 34. The support steps 24 and 26 allow an operator to stand on the I-beam 12 when it is vertical to observe the position of the I-beam and to have access to a control module 18.

The control module 18 is secured to the face of one of the support plates 20*a* or 20*b*. The control module 18 interfaces with a drive module including hydraulic supply/return hoses (lines) and the hydraulic cylinders (FIGS. 5 and 6) to drive the claw assemblies 14 and 16. The drive module is mounted on the excavator arm. There are two hydraulic cylinders for each claw assembly. Consequently, the control module 18 interfaces two hydraulic lines 40 and 42 to four pairs of hydraulic lines 50, 52, 54 and 56. One pair of lines is for each of the claw assemblies, as shown in FIG. 1, each pair including a supply line and a return line. Four levers 60, one for each claw, are provided allowing the operator to manipulate the claw assemblies 14 and 16 of the pile grabber 10.

The pile grabber 10 is attached to the arm 30 of an excavator equipment at the link support plates 20*a* and 20*b*. Specifically, two link pins 64 and 66 are inserted through the holes in the link support plates 20*a* and 20*b* and through holes in extension members 67 and 69 of the arm 30. The support plates 20*a* and 20*b* and link pins which pass therethrough form a "quick coupler" assembly to attach the I-beam member 12 onto the arm of the mobile excavating apparatus. The orientation of the I-beam 12 is controlled by the hydraulic cylinder 70 and associated link assembly 72 of the excavator arm 30.

Figures 3, 4:
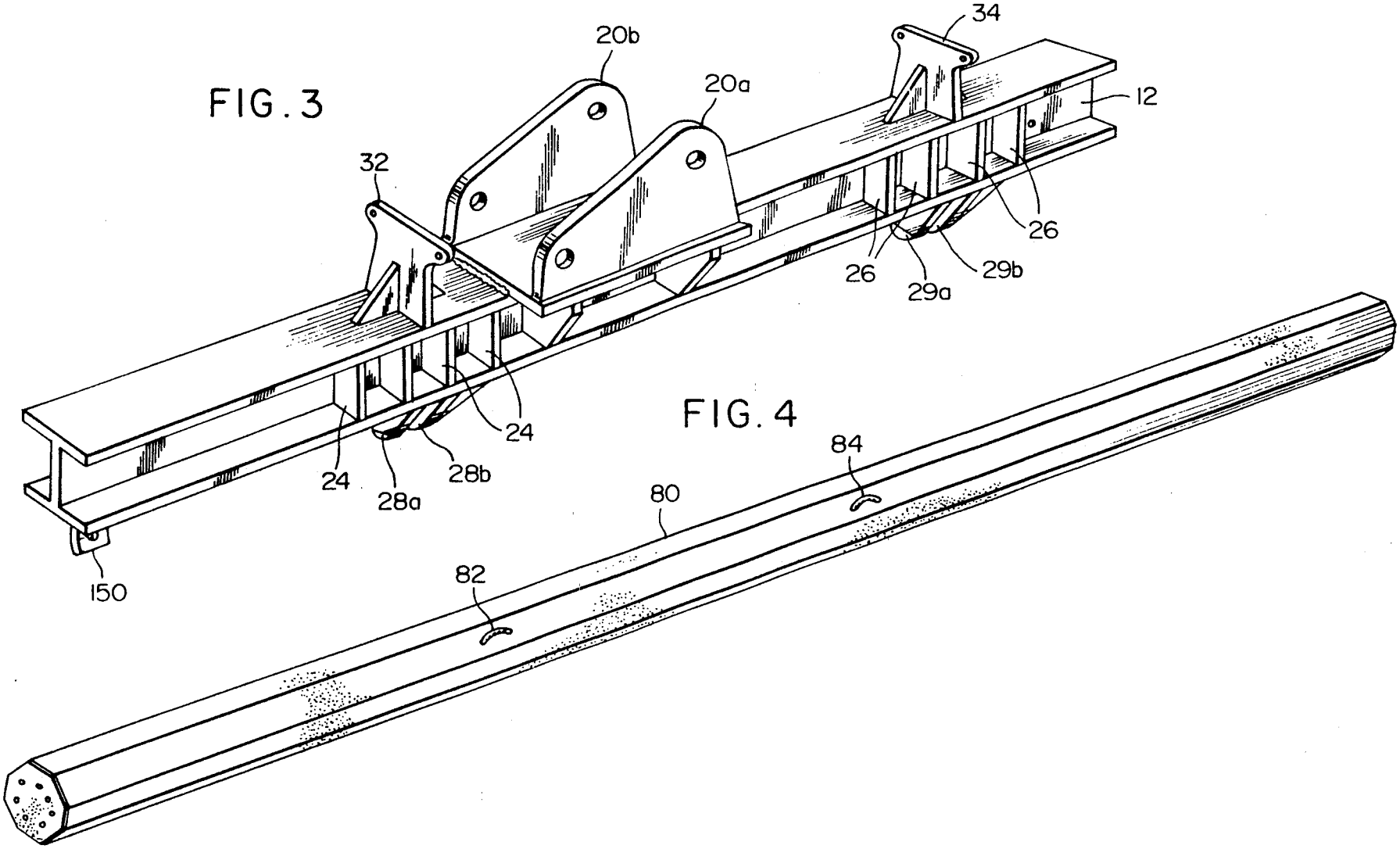
FIG. 3 is a perspective view of the I-beam on which the claws are mounted.
FIG. 4 is a perspective view of a typical concrete pile.

The claw assemblies 14 and 16 are designed to pick up and position a concrete pile 80, such as that shown in FIG. 4. The concrete pile 80 may take on various shapes and sizes. For example, as shown in FIG. 4, the pile 80 is octagonal in cross-section. Two eyelet members 82 and 84 are attached to the pile 80, the purpose of which will be described below.

Figure 6:
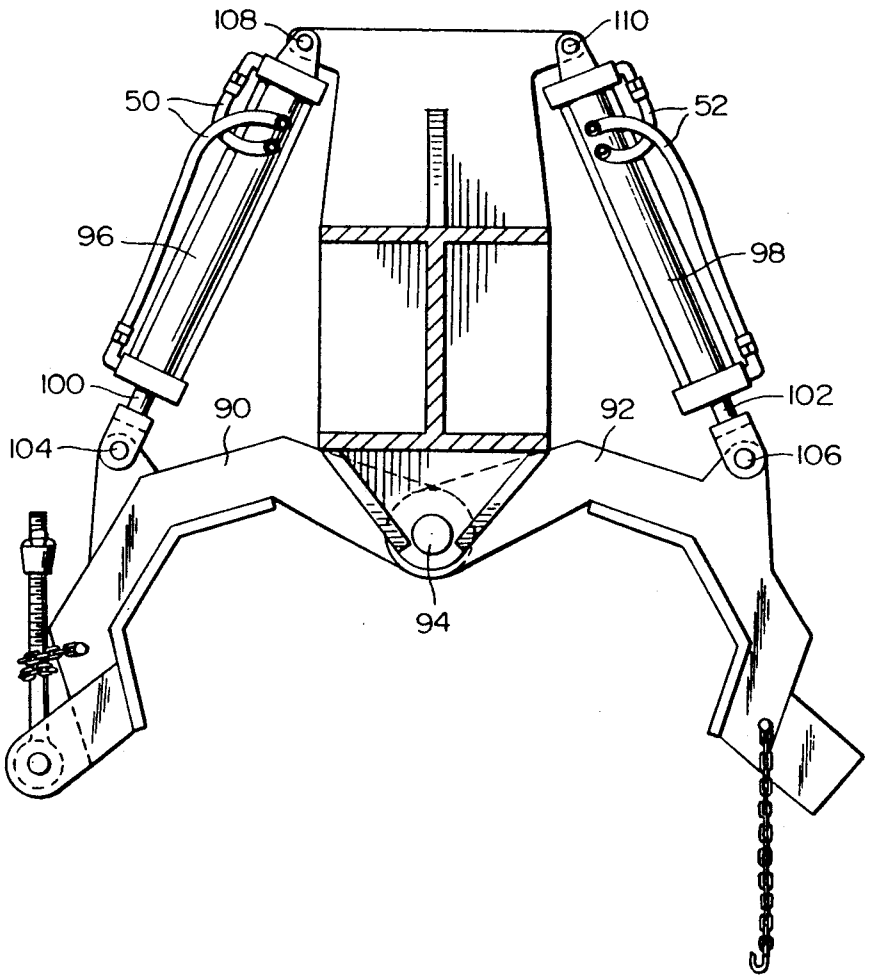
FIG. 6 is a sectional view similar to FIG. 5 but illustrating the claws in an open position.
Figure 5:
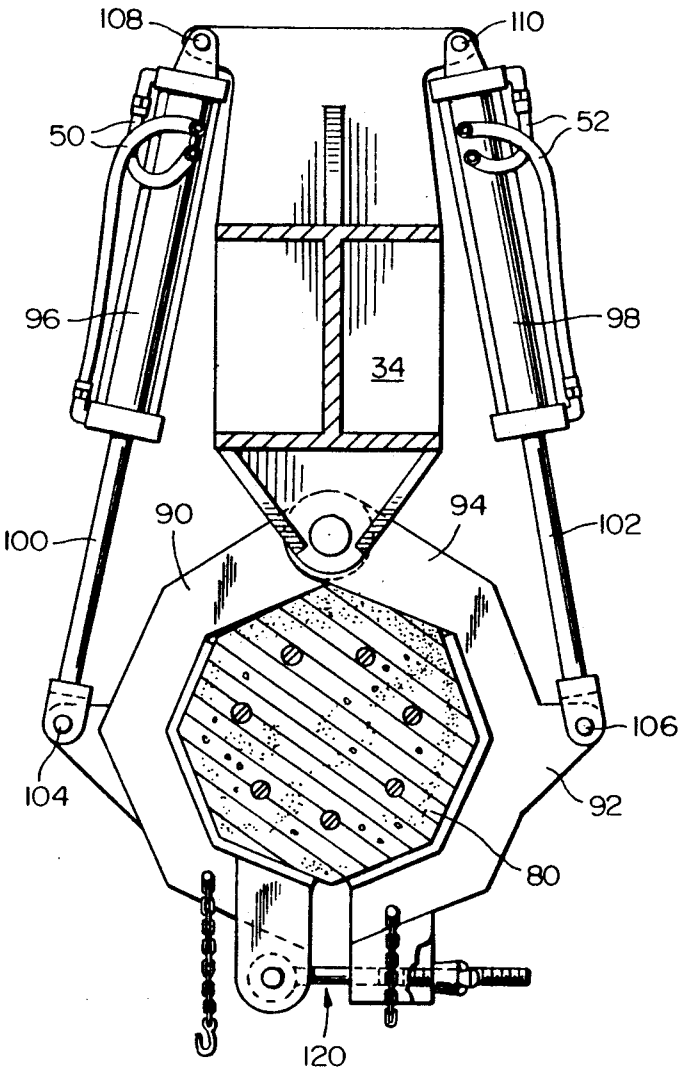
FIG. 5 is a sectional view taken along line 5—5 of FIG. 2.

Turning now to FIGS. 5 and 6, the structure of the claw assemblies 14 and 16 will be described in greater detail. Each claw assembly comprises two claws 90 and 92 connected to vertically supporting ears 28*a* and 28*b* via pin 94 and to a claw assembly support plate. (Claw assembly 16 is attached to the claw assembly support plate 34 and supporting ears 29*a* and 29*b* in the same manner.) Hydraulic cylinders 96 and 98 are provided for the claws 90 and 92, respectively. Pistons 100 and 102 of the hydraulic cylinders 96 and 98, respectively, are connected to lateral mid-points on the claws 90 and 92 by pins 104 and 106. The top of the hydraulic cylinders 96 and 98 are attached to the claw assembly support plate by pins 108 and 110. Hydraulic lines 50 and 52 supply the hydraulic cylinders 96 and 98, respectively.

Movement of the claws is controlled at the control module 18.

FIG. 5 illustrates the position in which the claws of the claw assembly are both closed around a pile 80. In this position the pistons 100 and 102 are fully extended from the cylinders 96 and 98. Consequently, the claws 90 and 92 are forced closed around the pile 80. FIG. 6 illustrates the claw assembly in a fully opened position. The pistons 100 and 102 are fully retracted into the cylinders 96 and 98 pulling the claws 90 and 92 apart and outward. The force of the hydraulic cylinders on the claws 90 and 92 is sufficient to hold a pile vertically.

An optional piece of equipment is a bolt and wing-nut assembly shown at 120. This piece of equipment may be used as a safety to hold the claws together. Again, however, it has been found that the hydraulic cylinders are strong enough to hold the pile without the wing-nut assembly.

Figure 2:
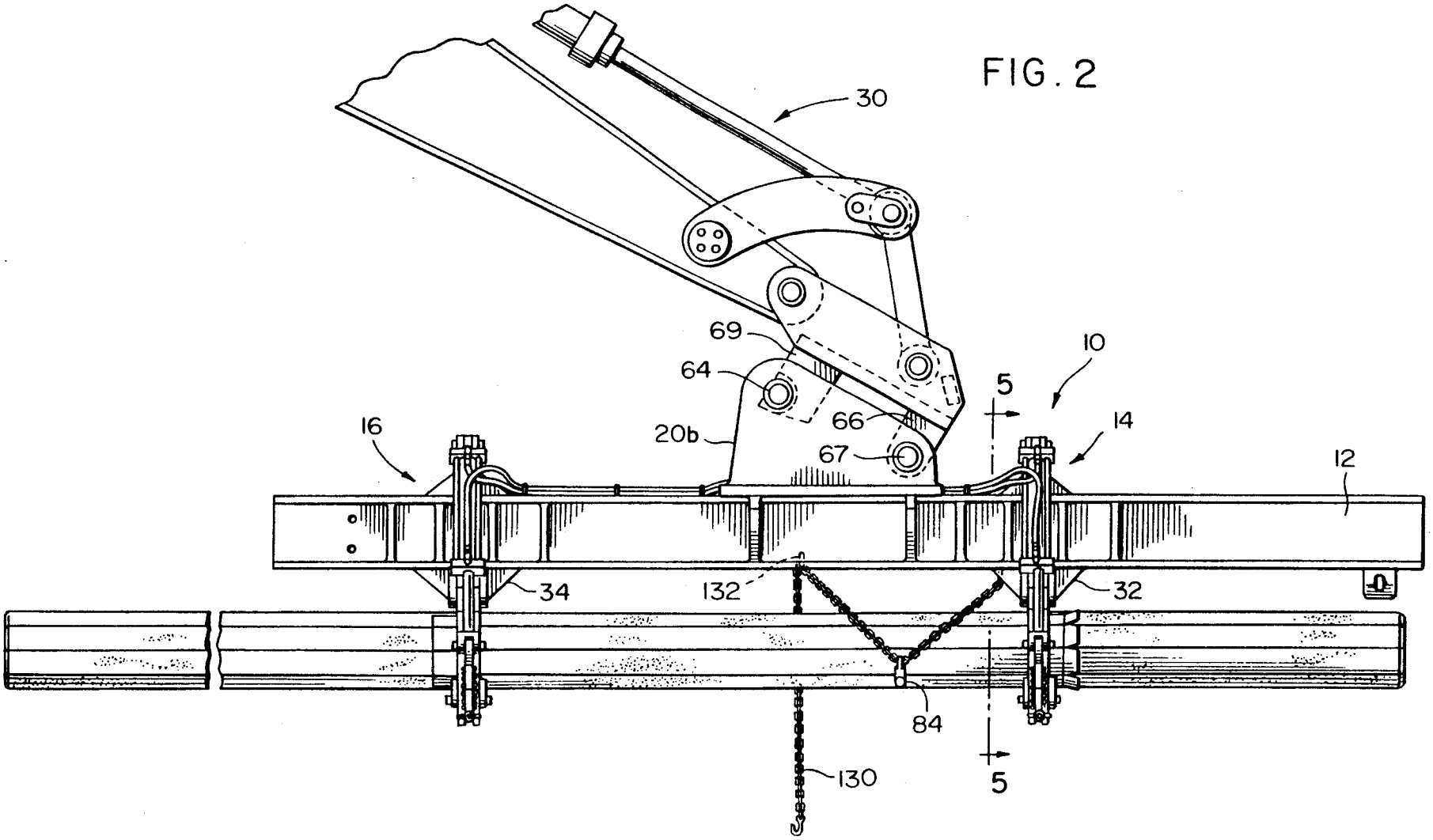
FIG. 2 is a side view of the pile grabber with a pile clamped within its claws.

As a further safety feature, a chain 130 is provided which is attached to the I-beam 12 as shown in FIG. 2. The chain 130 is passed through the eyelet members 82 and 84 on the pile 80 and secured to an eyelet 132 on the I-beam 12. This mechanism secures the pile to the I-beam, should the claw assemblies fail.

The function of the pile grabber 10 is to lift a concrete pile 80 from the ground and position the pile 80 in preparation for being driven into the ground. Referring first to FIG. 1, the pile grabber 10 is positioned by the excavator arm 30 horizontally above a concrete pile 80. An operator takes a position adjacent the control module 18 and uses the levers to manipulate the claw assemblies 14 and 16 around the pile 80. The chain 130 (FIG. 2) may be attached to the pile 80 and to the I-beam 12. Once the pile 80 is firmly secured in the grasp of the claw assemblies 14 and 16, the excavator may be moved to the position where the pile is to be driven.

Figure 7:
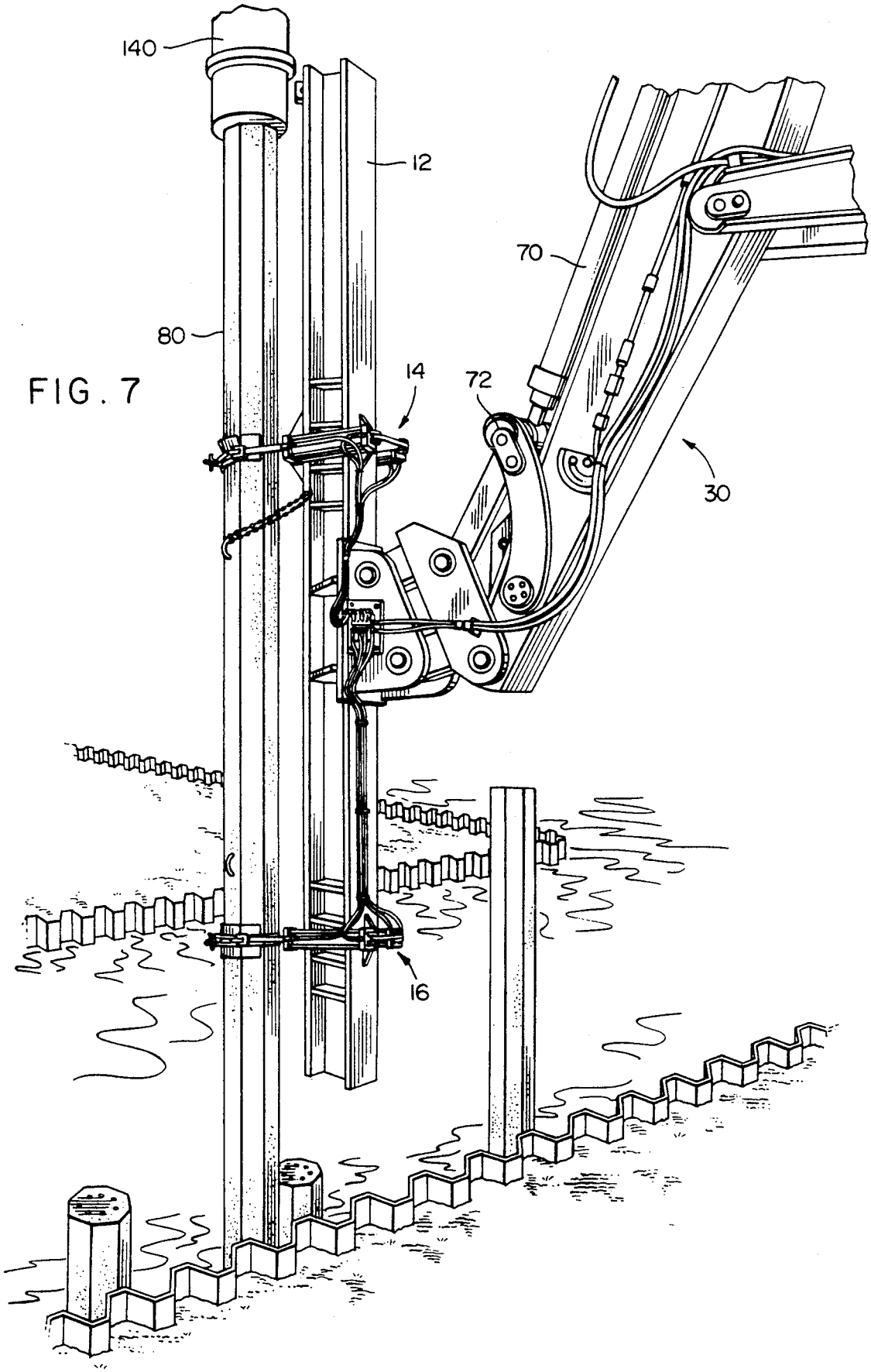
FIG. 7 is a perspective view of the pile grabber positioning vertically a pile in preparation for pounding into the ground.

The arm of the excavator then lifts the pile 80 to a vertical position over the spot where the pile is to be driven. This is illustrated in FIG. 7. The pile 80 is aligned by the arm 30 of the excavator and the claw assemblies so that the pile will be plumb. In this regard, an operator may stand on the support steps 24 and access the control module 18 to adjust the claw assemblies 14 and 16 to make the pile 80 plumb. Once the pile is plumb, a free pile driver (hammer) 140 is lifted by a crane (not shown) onto the head of the now positioned and plumb pile 80. The operator opens the claw assemblies slightly so that the pile 80 can slide through the claw assemblies as it is driven by the hammer 140.

As the pile is driven, the operator of the excavator and/or module adjusts the claw assemblies or moves the I-beam relative to the hammer 140 to maintain the pile plumb. In fact, the pile grabber can keep the pile true with only one claw assembly surrounding the pile. When the pile 80 has been driven far enough to stand on its own, the excavator and pile grabber are removed. The excavator is then free to return to the stock of additional concrete piles to grab the next pile and position it for pounding.

Clearly, the pile grabber affords many advantages over the traditional fixed lead methodology. With the pile grabber, only one crane and one excavator are needed to position and drive the pile. By contrast, a fixed lead system requires two cranes. Furthermore, no templates are needed to drive a pile with the pile grabber.

Just as important, the pile grabber saves time and cost. It has been found in experimental use, that the pile grabber is capable of piling an average of 17 piles per day while the fixed lead system piles an average of 5 piles a day.

Modifications to the structure and use may be made without departing from the scope and spirit of the invention. Depending on the length and depth of the pile, the pile grabber may be used with two claw assemblies to hold the pile, or with one claw assembly. For example, the upper claw assembly may be released and the I-beam elevated slightly so that only the lower claw assembly guides the pile. In the event, an extra-long pile is used, the chain 130 may be passed through the eyelet 150 (FIGS. 1 and 3) at the end of the I-beam 12 to tether the pile. In addition, the pile grabber as described may be modified to include the capability to rotate about the axis of the I-beam by providing additional hydraulic cylinders.

The above description is intended by way of example only and is not intended to limit the present invention in any way except as set forth in the following claims.

I claim:

1. An apparatus for grabbing and positioning a pile for insertion into the ground, the apparatus adapted to attach to a movable arm forming part of a mobile excavating apparatus, comprising:

an elongated support member;

clamping means comprising first and second clamping members each capable of adopting a closed position to grab a pile and securely hold a pile both horizontally and vertically, and an open position for releasing from a pile;

means for attaching the first and second clamping members onto the support member spaced apart from one another;

link plate support means secured to the support member for connecting the support member to a moveable arm of a mobile excavating apparatus; and control means secured to the support member for controlling the position of the clamping members, said control means controlling the first and second clamping members each for clamping onto a horizontally disposed pile and for orienting the pile vertically, and said control means further releasing slightly the first and second clamping members from the pile while force is applied to the pile from above to drive the pile into the ground.

2. The apparatus of claim 1, wherein the clamping means are hydraulic clamping means and wherein the control means interfaces hydraulic lines supplied from the first and second mobile excavating apparatus with hydraulic lines feeding the clamping means, said control means including levers for controlling the hydraulic pressure to the clamping means.

3. The apparatus of claim 1, wherein the support member is elongated.

4. The apparatus of claim 1, wherein the first and second pairs of clamping members comprises first and second opposing claw members, and said means for attaching comprises means for mounting the clamping members so that the first and second claw members open and close transverse to the support member.

5. The apparatus of claim 3, wherein the support member is an I-beam.

6. The apparatus of claim 1, and further comprising chain means secured to the support member for attaching to a pile to secure a pile to the support member.

7. The apparatus of claim 4, wherein the means for attaching includes supporting ears attached to the support member and a pin which passes through the first and second opposing claw members and said supporting ears to permit the first and second claw members to pivot towards and away from each other about the pin.

8. A method for grabbing a pile, positioning the pile above the ground and pounding the pile into the ground comprising the steps of:

clamping with clamping means a horizontally disposed pile lying on the ground;

lifting the clamped pile off the ground by raising the clamping means;

moving the pile to a site for pounding into the ground;

orienting the pile vertically by orienting the clamping means in a proper position with respect to vertical;

adjusting the orientation of the clamping means to make the pile plumb with the ground;

moving a pile hammer in position on top of the vertically positioned pile;

releasing partially the clamping means from the pile to allow the pile to substantially freely move downwards;

driving the pile into the ground by actuating the pile hammer; and releasing completely the clamping means from the pile once the pile is driven sufficiently into the ground.

9. The method of claim 8, and further comprising the step of further adjusting the orientation of the pile alternately with the step of driving by adjusting the position of the clamping means.

10. The method of claim 8, wherein the step of moving the pile comprises moving a mobile excavating apparatus.

11. A method for grabbing a pile, positioning the pile above the ground and pounding the pile into the ground comprising the steps of:

mounting first and second clamping means on an elongated support member displaced from each other;

attaching the support member to a moveable arm of a mobile excavating apparatus;

clamping with the first and second clamping means a horizontally disposed pile lying on the ground;

lifting the clamped pile off the ground by raising the arm of the mobile excavating apparatus;

moving the mobile excavating apparatus to a site for pounding the pile into the ground;

orienting the pile vertically by orienting the support member vertical;

adjusting the orientation of the support member to make the pile plumb with the ground;

moving a crane supporting a pile hammer in position on top of the vertically positioned pile;

releasing partially the first and second clamping means from the pile to allow the pile to substantially freely move downwards;

driving the pile into the ground by actuating the pile hammer; and releasing completely the clamping means from the pile once the pile is driven sufficiently into the ground.

12. The method of claim 11, wherein the step of adjusting the orientation of the first and second clamping means comprises controlling the hydraulic pressure supplied to the first and second clamping means.

13. The method of claim 12, and further comprising the step of supplying hydraulic pressure to the first and second clamping means via a source of hydraulic pressure provided on the mobile excavating apparatus.

14. A method for grabbing and positioning a pile above the ground in preparation for pounding into the ground, comprising the steps of:

mounting clamping means on an elongated support member displaced from each other;

attaching the support member to a moveable arm of a mobile excavating apparatus;

clamping with said clamping means a horizontally disposed pile lying on the ground;

lifting the clamped pile off the ground by raising the arm of the mobile excavating apparatus;

moving the mobile excavating apparatus to a site for pounding the pile into the ground;

orienting the pile vertically by orienting the support member vertical;

adjusting the orientation of the support member to make the pile plumb with the ground.

* * * * *